US005600108A

United States Patent [19]

Newham

[11] Patent Number: 5,600,108

[45] Date of Patent: Feb. 4, 1997

[54] DOCKING MODULE ENCLOSURE INCLUDING CONNECTORS AND POWER SWITCHING

[75] Inventor: Paul F. Newham, San Antonio, Tex.

[73] Assignee: Bed-Check Corporation, Tulsa, Okla.

[21] Appl. No.: 297,402

[22] Filed: Aug. 29, 1994

[51] Int. Cl.[6] ..... H01H 9/00; A61G 7/00; H01R 13/70

[52] U.S. Cl. ..... 200/50.28; 5/600; 340/573; 439/924.1

[58] Field of Search ..... 200/50 B, 51.09, 200/51.1; 340/540, 573, 575, 666; 439/181–189, 924, 924.1; 5/658, 600

[56] References Cited

U.S. PATENT DOCUMENTS

| | | | |
|---|---|---|---|
| 1,731,973 | 10/1929 | Fischer | 200/50 B X |
| 3,198,891 | 8/1965 | Burst et al. | 200/50 C |
| 3,512,043 | 5/1970 | Jaaksoo et al. | 200/51.1 |
| 3,569,908 | 3/1971 | Appleton | 439/924.1 |
| 3,781,843 | 12/1973 | Harrison et al. | 340/573 |
| 4,044,208 | 8/1977 | McDonald et al. | 200/51.09 |
| 4,228,426 | 10/1980 | Roberts | 340/573 |
| 4,403,214 | 9/1983 | Wolar | 340/540 |
| 4,484,043 | 11/1984 | Musick et al. | 200/85 R |
| 4,565,910 | 1/1986 | Musick et al. | 200/85 R |
| 4,705,921 | 11/1987 | Rabey et al. | 200/50 B |
| 4,777,944 | 10/1988 | Green et al. | 340/573 X |
| 4,917,619 | 4/1990 | Nishiwaki | 439/191 |
| 4,927,382 | 5/1990 | Huber | 439/924.1 X |
| 5,072,906 | 12/1991 | Foster | 5/658 X |
| 5,137,464 | 8/1992 | Maue et al. | 439/924 X |
| 5,375,604 | 12/1994 | Kelly et al. | 128/671 |
| 5,434,752 | 7/1995 | Huth et al. | 361/798 |

*Primary Examiner*—J. R. Scott

*Attorney, Agent, or Firm*—Frank J. Catalano; Scott R. Zingerman

[57] ABSTRACT

An enclosure is provided for mounting a bed monitoring docking module on a bed frame structure. The enclosure has an elongated sleeve-like housing with an interior cross-section substantially complimentary to the outer cross-section of the docking module. The docking module is slidably insertable into and removable from a supported position within the sleeve-like housing through an open forward end of the housing. A connector housing mounted within a back end of the sleeve-like housing contains enclosure power, control and sensor connectors which are matable with respective externally accessible docking module and sensor mat connectors. The connector housing has an aperture through a wall thereof for mounting the enclosure sensor connector for interfacing with the mat sensor connector and a pair of apertures through a forward wall thereof for mounting the enclosure power and control connectors in alignment for interfacing with the docking module power and control connectors as the module is inserted into the sleeve-like housing. The forward wall of the connector housing is contoured to position the enclosure power and control connectors such that, during insertion and removal, the control interface is connected before the power interface and the power interface is disconnected before the control interface, respectively.

15 Claims, 3 Drawing Sheets

DOCKING MODULE ENCLOSURE INCLUDING CONNECTORS AND POWER SWITCHING

BACKGROUND OF THE INVENTION

This invention relates generally to equipment for monitoring the presence of a patient in a hospital bed or the like and more particularly concerns enclosures for supporting the docking module component of a bed monitoring system.

The components of a bed monitoring system generally include a sensor mat located on the bed to sense the presence of the patient in the bed, a remote monitoring station such as a nurses station or the like where indicia of the patient's presence are displayed and the docking module which contains the power and control systems necessary to interconnect the mat with the remote monitoring station and to provide the desired monitoring functions. The monitoring station is essentially a central, permanent, fixed hardware network capable of simultaneously monitoring a great number of beds. The sensor mat is a relatively inexpensive, disposable and easily stored device of the type disclosed in earlier U.S. Pat. Nos. 4,484,043 and 4,565,910 and pending patent application Ser. No. 08/281,431 filed Jul. 27, 1994. The docking module on the other hand, is a relatively expensive, non-disposable device. A limited number are kept available and are mounted on or proximate the particular bed to be monitored as the need arises.

While it is not economically desirable to provide a docking module for every bed in a hospital, it may become desirable from time to time to monitor any of the hospital beds. The present practice is to mechanically fasten the docking module to or proximate the bed to be monitored when that need arises, and when that need is ended to mechanically disconnect and retrieve the module from the bed. This mechanical process is time consuming and requires the attention of personnel specifically assigned to and trained for the task. In every application, subjective decisions must be made as to where to mount the docking module so as to make connection of the module between the mat and the remote station relatively easy and yet maintain the integrity of the system against intended or inadvertent tampering or disruption by a patient or visitor. Once located, proper connections of the sensor mat cable and remote monitoring station cables to the docking module must be made. Unfortunately, due in part to the inconsistencies in location of the module and wiring, the integrity of the connected circuits may be compromised. These tasks and decisions are further complicated by the wide variety of bed frame structures generally found within a hospital. Consequently, in the present practice, inconsistent arrangements of cables in hospital rooms often cause less than optimally convenient, comfortable and safe for the patient and visitors. Moreover, the confidence and comfort level of the staff in administering the monitoring system in a manner most effective for the patient is also diminished.

It is, therefore an object of the present invention to provide an enclosure for receiving a bed monitoring docking module which makes it economically possible to permanently mount such an enclosure on or proximate each and every hospital bed. Another object of this invention is to provide an enclosure for a bed monitoring docking module with a dedicated cable connected to the enclosure so that all in-room cables are optimally and permanently positioned. A further object of this invention is to provide an enclosure for a bed monitoring docking module which facilitates immediate connection of a docking module in the monitoring subsystem of any given bed as the need should arise. It is also an object of the present invention to provide an enclosure for receiving a bed monitoring docking module which enhances the integrity of the electrical connections between the monitoring system components. Yet another object of this invention is to provide an enclosure for a bed monitoring docking module which is adapted for mounting on a wide variety of bedframe structures.

SUMMARY OF THE INVENTION

In accordance with the invention, an enclosure is provided for mounting a bed monitoring docking module on a bed frame structure. The enclosure has an elongated sleeve-like housing with an interior cross-section substantially complimentary to the outer cross-section of the docking module. The docking module is slidably insertable into and removable from a supported position within the sleeve-like housing through an open forward end of the housing. A connector housing mounted within a back end of the sleeve-like housing contains enclosure power, control and sensor connectors which are matable with respective externally accessible docking module and sensor mat connectors. The connector housing has an aperture through a wall thereof for mounting the enclosure sensor connector for interfacing with the mat sensor connector and a pair of apertures through a forward wall thereof for mounting the enclosure power and control connectors in alignment for interfacing with the docking module power and control connectors as the module is inserted into the sleeve-like housing. The forward wall of the connector housing is contoured to position the enclosure power and control connectors such that, during insertion and removal, the control interface is connected before the power interface and the power interface is disconnected before the control interface, respectively.

Thus, a docking module enclosure may be connected to every hospital bed with cables to the enclosures permanently included in the bed wiring harness. Any bed to be monitored can then be immediately, securely and conveniently connected to the monitoring network by simply inserting a docking module into the docking enclosure of the bed to be monitored.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
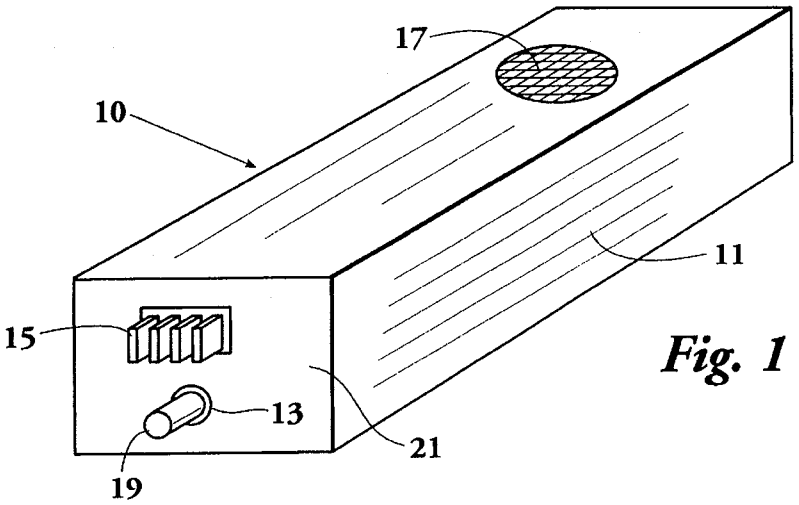
FIG. 1 is a perspective view of a bed monitoring docking module.

Turning first to FIG. 1, a docking module 10 for use with the present docking module enclosure 30 is illustrated. The module 10 consists of a case 11 containing the power and control circuits (not shown) of the module and having an externally accessible power connector 13 and an externally accessible control connector 15. The docking module 10 may also include an audio speaker 17 so as to provide an audible indication at the bed site of the patient's presence in or absence from the bed. As shown, the power connector 13 and the control connector 15 have been specially selected for compatibility with the docking module enclosure 30 and the power connector 13 is provided with a prong 19 extending perpendicularly to the rear face 21 of the docking module 10.

Figure 2:
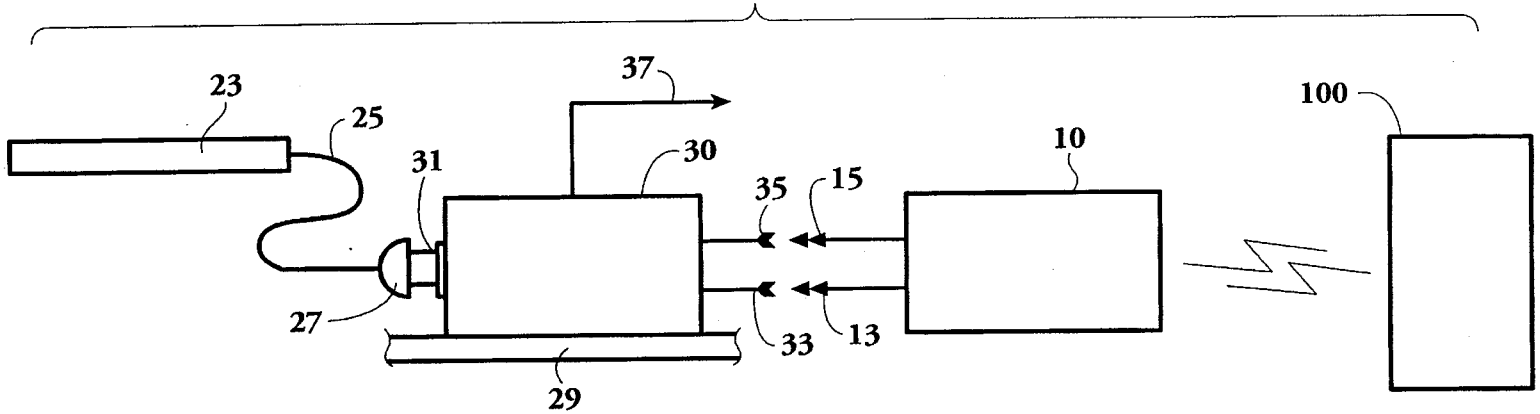
FIG. 2 is a block diagram of a bed monitoring system incorporating the docking module enclosure of the present invention.

Looking at FIG. 2, a sensor mat 23 which will be disposed on the hospital bed mattress (not shown) is electrically connected via a cord 25 to a sensor connector 27. The mat 23 is essentially a switching device whose on/off status is determined by distortion of or pressure on the mat 23 resulting from the presence or absence of a patient on the mattress. The sensor connector 27 in present practice, is normally connected to its associated docking module after the docking module has been permanently fixed to or proximate the bed. As shown, however, in the practice of the present invention, the docking module enclosure 30 is permanently secured to the bed frame 29. The enclosure 30 has external sensor connectors 31 and power and control connectors 33 and 35 which are matable with the mat sensor connector 27 and module power and control connectors 13 and 15, respectively. Power and control wiring 37 to the enclosure may therefore be a permanent part of the hospital bed wiring harness (not shown) and communication to the remote monitoring station 100 can be accomplished via the wiring 37 or by wireless communication.

Figure 3:
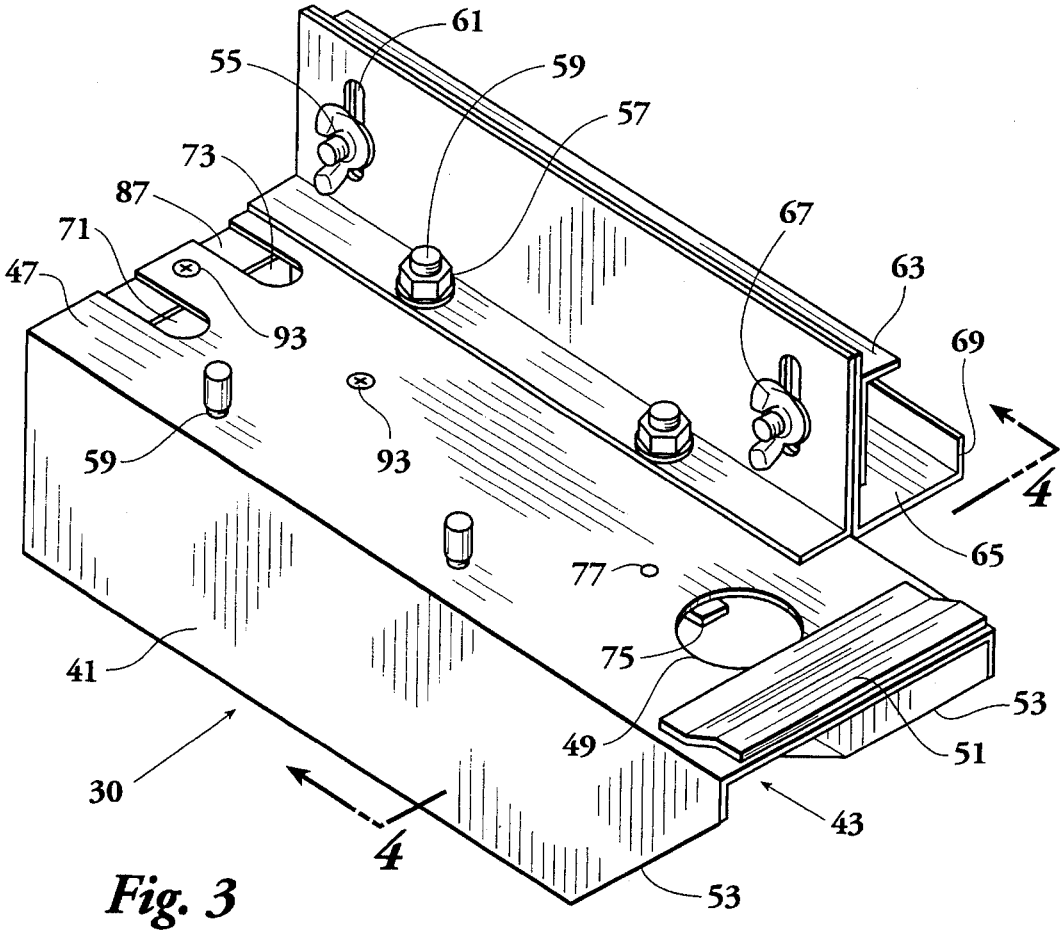
FIG. 3 is a perspective view of a preferred embodiment of the sleeve-like housing of the docking module enclosure.
Figure 4:
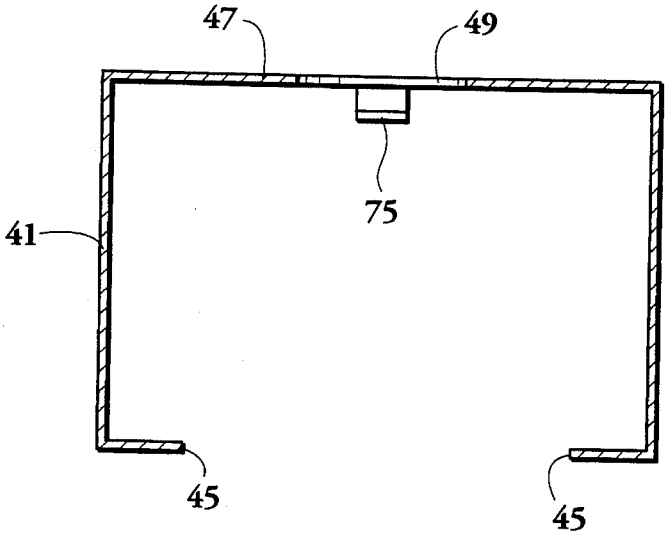
FIG. 4 is a sectional view taken along the line 4—4 of FIG. 3.

Turning now to FIGS. 3 and 4, the sleeve-like housing 41 of the docking module enclosure 30 is illustrated. As shown, the housing 41 has a substantially channel or C-shaped cross-section having an inner contour substantially complementary to the outer contour of the docking module case 11. Thus, the back face 21 of the docking module 11 can be somewhat snugly inserted into an open front end 43 of the enclosure 30 and the module 10 will be supported by the lower flanges 45 of the channel or C-shaped housing 41. As shown, the top 47 of the housing 41 is provided with an audio aperture 49 which will be aligned with the audio speaker 17 of the module 10 when the module 10 is fully inserted into the sleeve-like housing 41. Preferably, a protective lip 51 extends outwardly from the sleeve-like housing 41 and forward of the speaker aperture 49 to protect the speaker 17 from damage when it is aligned with the aperture 49. Preferably, the front portion 43 of the sleeve-like housing 41 will have a taper 53 to its sidewalls extending rearwardly from top to bottom so as to facilitate easy insertion and removal of the docking module 10 into and from the sleeve-like housing 41.

As shown in FIG. 3, to facilitate mounting of the docking module enclosure 30 to the bed frame (not shown), a bracket assembly is mounted on an outer surface of the sleeve-like housing 41. Preferably, the bracket assembly consists of an elongated L-shaped bracket such as the angle iron 55 which is fastened to the top 47 of the housing 41 by bolts 57 applied to threaded posts 59 extending upwardly from the housing 41. The posts are positioned so that the angle iron 55 will have one of its legs extending upwardly in alignment with a sidewall of the housing 41. The upwardly extending leg of the angle iron 55 is provided with slots 61 for connection of an adjustable clamp. As shown, the adjustable clamp consists of additional angle irons 63 and 65 adjustably connected in back-to-back relationship to the first angle iron 55 by the use of wing nuts 67. As shown, the horizontal portion of the upper angle iron 63 is shorter than the horizontal portion of the lower angle iron 65 and the lower angle iron 65 has an upwardly extending flange 69. By loosening of the wing nuts 67 to vary this geometry, the angle irons 63 and 65 can be manipulated to grip any of a wide variety of structural shapes presented by a given bed frame (not shown). As shown, threaded posts 59 will preferably be provided on both sides of the sleeve-like housing 41 so that the bracket assembly can be connected to either side of the housing 41. Also, as shown, the top of the housing 41 is provided with a pair of slots or apertures 71 and 73 for extension of power and control wiring 37 to and from the docking module enclosure 30. A U-shaped spring clip 75 may also be secured to the underside of the top 45 of the housing 41 by use of a screw or rivet (not shown) through an aperture 77 provided in the housing 41 to assure that the module 30 is securely held within the enclosure 10.

Figure 5:
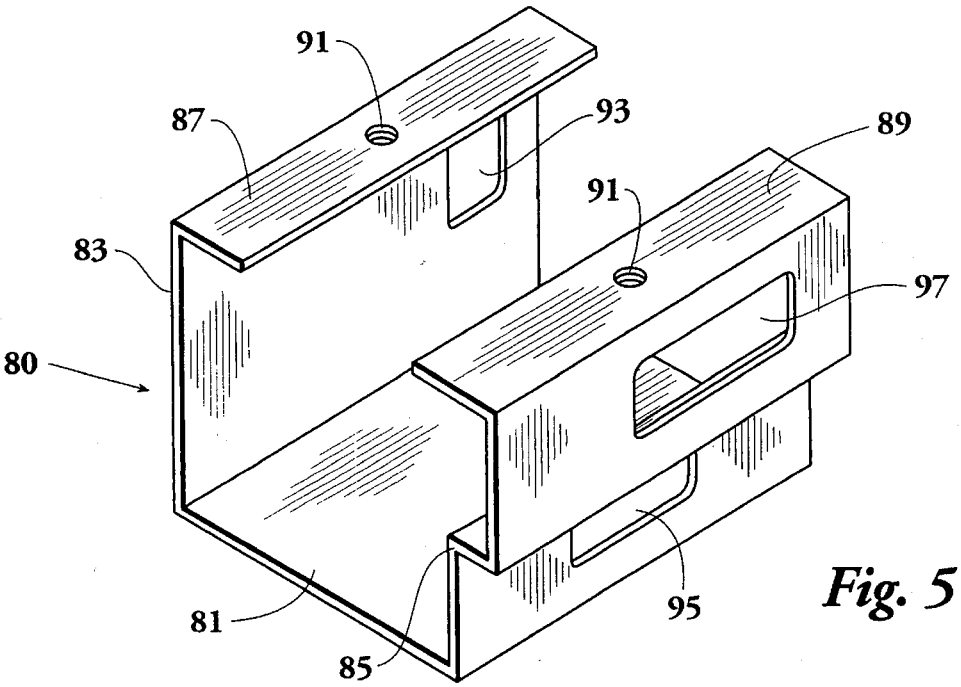
FIG. 5 is a perspective view of a preferred embodiment of the connector housing of the docking module enclosure.
Figure 6:
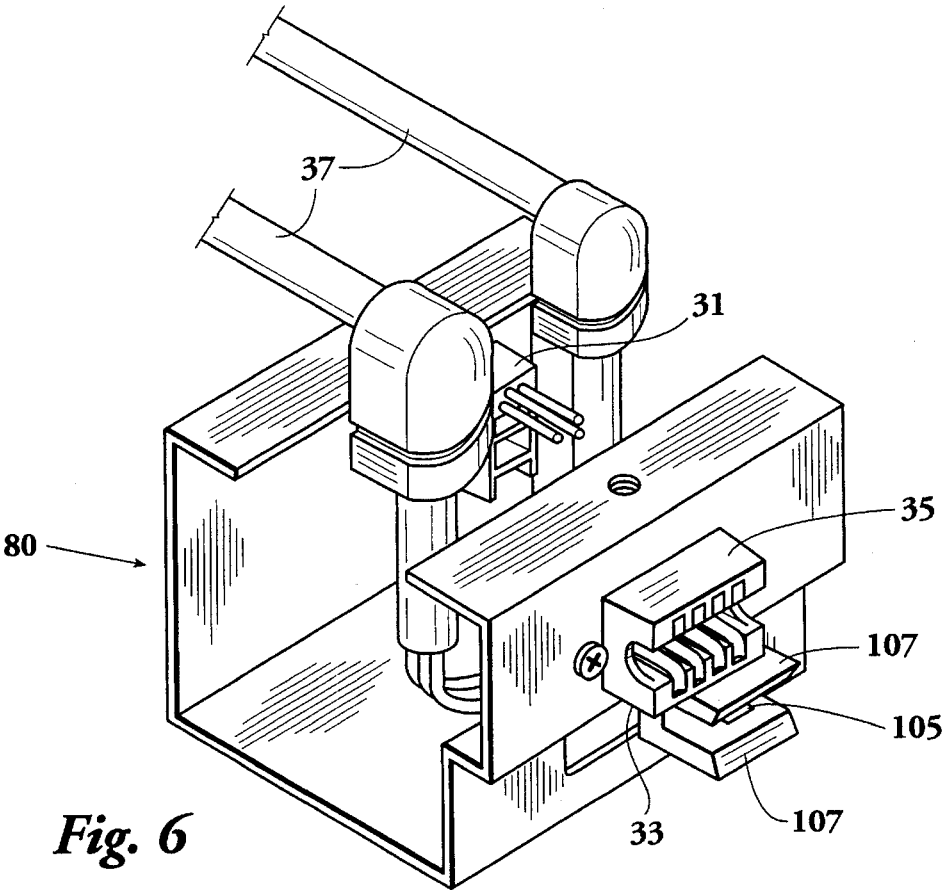
FIG. 6 is a perspective view of the connector housing of FIG. 5 with a preferred embodiment of the enclosure power, control and sensor connectors mounted therein.

Turning now to FIGS. 5 and 6, a connector housing 80 for containing and supporting the power, control and sensor connectors and wiring of the docking module enclosure 30 is illustrated. As shown, the connector housing 80 consists of a substantially C-shaped member having a base 81, and back and front faces 83 and 85 and back and front flanges 87 and 89. The flanges 87 and 89 are provided with threaded apertures 91 so that the connector housing 80 can be fastened in the rear portion of the sleeve-like housing 41 by screws 93 as shown in FIG. 3. The back face 83 is provided with a sensor connector aperture 94 and the front face 85 is provided with power and control connector apertures 95 and 97. As shown, the front face 83 of the connector housing 80 is contoured to place the control connector aperture 97 forward of the power connector aperture 95. As can best be seen in FIG. 6, the control connector 35 is selected to mate with the control connector 15 of the docking module and extends forwardly from the control connector aperture 97 so as to interface with the docking module control connector 15 as the docking module 10 is inserted into the docking module enclosure 30. The power connector 33 is mounted in the power connector aperture 95 and includes a resiliently biased plunger 105 preferably disposed between upper and lower guiding and shielding extensions 107. Compression and expansion of the resiliently biased plunger 105 switches power in the docking module enclosure circuits on and off, respectively. The plunger 105 is located for alignment with the prong 19 on the docking module 10 and the extensions 107 assure proper engagement between the plunger 105 and the prong 19 and also prevent inadvertent operation of the plunger 105. Given this physically staggered relationship of the power and control connectors 33 and 35, as the docking module 10 is inserted into the docking module enclosure 30, the interfacing of the control connectors 15 and 35 will be securely completed before the interfacing of the power connectors 13 and 33 is completed and before the prong 19 and plunger 105 have completed the power switching. Conversely, upon removal of the docking module 10 from the docking module enclosure 30, the power switch will be turned off and the power interface interrupted before interruption of the control interface. The sensor connector 31 is mounted in the sensor connector aperture 94 for connection with the connector 27 associated with the sensor mat 23.

A brief review of the above description and the drawings of the various elements or components and how these co-operate may be helpful. The parts illustrated in FIGS. 3, 4, 5, and 6 when assembled form a receiving unit which is secured to a bed and is left there. The docking module 10 is not inserted into this unit until it is desired to connect that bed to the monitoring system. To assemble the unit, enclosure 30 is secured to a bed by use of the described mounting bracket assembly including angle irons 55 and 65 which is mounted on the top surface of the sleeve-like housing 41. This forms a permanent fixture to the bed. The connector housing 80, shown in FIGS. 5 and 6, is secured to the enclosure 30 by screws 93 screwed to threaded aperture 91. Before the connector housing 80 is mounted inside the enclosure 30, the control connector 35 and the power connector 33 are attached to the connector housing 80 (FIG. 6). This connector 35 is a type to receive the control connector 15 on the docking module 10. The housing 80 is then mounted inside the enclosure 30. The power connector 33 is mounted on the connector housing 80. The power connector 33 and the control connector 35 are positioned to receive the power connector 13 and the control connector 15 of the docking module 10.

When a particular bed is to be connected to a monitoring system, the module 10 (FIG. 1) is inserted into the enclosure 30 until the control connector 15 (on the module 10) engages the control connector 35 and the power connector 15 of docking module is inserted into the power connector 33. This illustrates the special relationship of the various parts to provide a useful alarm and monitor system for a bed. When that bed is no longer to be monitored the docking module (FIG. 1 ) is simply withdrawn.

Many variations of the specific structure herein disclosed are possible depending upon the desired contour and contact configuration of the docking module itself. It is contemplated that any such docking module contour and contact configurations can be accommodated by a suitably configured docking module enclosure, so as long as the enclosure is contoured to support the docking module, is adapted for mounting to a wide variety of bed frame structures and provides power and control interfaces physically arranged to insure that power is not applied to the network prior to firm connection of the control circuit components.

Thus, it is apparent that there has been provided, in accordance with the invention, a docking module enclosure that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For mounting a docking module on a bed having a mat disposed thereon which senses the presence and absence of a patient in and from the bed for indication thereof at a remote monitoring station, said module having a case with externally accessible power and control connectors and said mat having a sensor connector, an enclosure comprising:

an elongated sleeve-like housing having an interior cross-section substantially complimentary to an outer cross-section of the docking module and an open forward end for slidably inserting and removing the docking module into and out of a supported position within said sleeve-like housing; and a connector housing mounted within a back end of said sleeve-like housing for containing enclosure power, control and sensor connectors matable with their respective module and mat connectors, said connector housing having an aperture through a wall thereof for mounting of said enclosure sensor connector therein for interfacing with said mat sensor connector and a pair of apertures through a forward wall thereof for mounting of said enclosure power and control connectors therein in alignment for interfacing with the docking module power and control connectors as the module is inserted into said sleeve-like housing, said wall being contoured to position said enclosure power connector and control connector such that, during said insertion and removal, said control connector is connected before said power connector and said power connector is disconnected before said control connector, respectively.

2. An enclosure according to claim 1 further comprising means mounted to an outer surface of said sleeve-like housing for fastening said enclosure to a frame of the bed.

3. An enclosure according to claim 2, said fastening means comprising a bracket assembly adjustable for gripping a component of the bed frame.

4. An enclosure according to claim 1 further comprising an aperture disposed through a wall of said sleeve-like member for alignment with an audio speaker on said module when said module is fully inserted into said sleeve-like member.

5. An enclosure according to claim 4 further comprising means mounted on and extending outwardly from said sleeve-like member and forward of said speaker aperture for protecting the speaker when the speaker is aligned with said speaker aperture.

6. An enclosure according to claim 1, the module being of substantially rectangular cross-section and said sleeve-like member being a channel of substantially C-shaped cross-section.

7. An enclosure according to claim 6 further comprising an elongated L-shaped bracket fixed to said sleeve-like member and having one leg thereof extending upwardly in alignment with a side wall of said channel and an elongated adjustable clamp mounted on said leg.

8. An enclosure according to claim 7, said bracket being detachably securable to said sleeve-like member in alignment with either side wall of said channel.

9. An enclosure according to claim 6, said channel having side walls tapered rearwardly from a forward end thereof.

10. An enclosure according to claim 1, said enclosure power connector having means thereon for switching power through said connector on and off in response to insertion and removal of said docking module into and out of said sleeve-like housing, respectively.

11. An enclosure according to claim 10, said switching means comprising a resiliently biased plunger extending forwardly from said enclosure power connector for compression and expansion during insertion and removal of said docking module into and out of said sleeve-like housing, respectively.

12. An enclosure according to claim 11, the docking module power connector having a prong extending rearwardly therefrom and in alignment with said plunger for engagement therewith during said insertion and removal.

13. An enclosure according to claim 12, said enclosure power connector having means for guiding said prong into engagement with said plunger and for shielding said plunger from engagement with objects other than said prong.

14. For mounting a docking module on a bed having a mat disposed thereon which senses the presence and absence of a patient in and from the bed for indication thereof at a remote monitoring station, said module having a case with externally accessible power and control connectors and said mat having a sensor connector, an enclosure comprising:

an elongated sleeve-like housing having an interior cross-section substantially complimentary to an outer cross-section of the docking module and an open forward end for slidably inserting and removing the docking module into and out of a supported position within said sleeve-like housing; and a connector housing mounted within a back end of said sleeve-like housing containing enclosure power, control and sensor connectors matable with their respective module and mat connectors, said enclosure sensor connector extending through an aperture in said connector housing for engaging said mat sensor connector and said enclosure power and control connectors extending through a pair of apertures through a forward wall thereof in alignment for engaging the docking module power and control connectors as the module is inserted into said sleeve-like housing, said wall being contoured to position said enclosure power and control connectors such that, during said insertion and removal, said engagement of the control connectors occurs before engagement of said power connectors and said power connectors are disconnected before said control connectors.

15. A bed monitoring system comprising:

means disposable on a bed for sensing the presence and absence of a patient in and from the bed for indication thereof at a remote monitoring station, said sensing means having a sensor connector;

a docking module having a case with externally accessible power and control connectors;

an elongated sleeve-like housing having an interior cross-section substantially complimentary to an outer cross-section of said docking module and an open forward end for slidably inserting and removing said docking module into and out of a supported position within said sleeve-like housing; and a connector housing mounted within a back end of said sleeve-like housing containing local power, control and sensor connectors matable with their respective module and mat connectors, said local sensor connector extending through an aperture in said connector housing for engaging with said mat sensor connector and said local power and control connectors extending through a pair of apertures through a forward wall thereof in alignment for engaging with the docking module power and control connectors as the module is inserted into said sleeve-like housing, said wall being contoured to position said local power and control connectors such that, during said insertion and removal, said control connectors are connected before said power connectors are engaged and said power connectors are disconnected before said control connectors are engaged.

* * * * *